United States Patent [19]

Hashimoto et al.

[11] Patent Number: 5,035,366

[45] Date of Patent: Jul. 30, 1991

[54] PAPER SHREDDER WITH SERVICE POWER OUTLET

[75] Inventors: Minoru Hashimoto; Haruyoshi Migita, both of Nara, Japan

[73] Assignee: Sharp Kabushiki Kaisha, Osaka, Japan

[21] Appl. No.: 511,977

[22] Filed: Apr. 17, 1990

Related U.S. Application Data

[63] Continuation of Ser. No. 372,128, Jun. 27, 1989, abandoned, which is a continuation of Ser. No. 163,532, Mar. 3, 1988, abandoned.

[30] Foreign Application Priority Data

Mar. 9, 1987 [JP] Japan ..... 62-34248

[51] Int. Cl.[5] ..... B02C 25/00

[52] U.S. Cl. ..... 241/36; 241/37.5; 241/100; 241/101.1; 241/101.3

[58] Field of Search ..... 220/1 T, 3.3; 232/43.1; 439/131; 83/701, 859, 477.2; 312/223; 144/285 R, 286 R, 286 A; 241/101.1, 101.2, 285 R, 36, 285 A, 236, 100, 37.5, 101.3

[56] References Cited

U.S. PATENT DOCUMENTS

| | | | |
|---|---|---|---|
| 4,269,364 | 5/1981 | Moriconi et al. | 241/36 |
| 4,336,733 | 6/1982 | Macksoud | 83/477.2 |
| 4,754,933 | 7/1988 | Leuthold et al. | 241/100 X |

*Primary Examiner*—Mark Rosenbaum

*Attorney, Agent, or Firm*—Irell & Manella

[57] ABSTRACT

A paper shredder is provided not only with cutters for cutting paper, a driver for driving the cutters and a power source for the driver, but also with a service power outlet from which power can be supplied to an external electrical equipment such as a vacuum cleaner. A door is provided to cover the outlet such that the driver can be operated only while the door is closed and cannot be switched on if the door stays open.

2 Claims, 2 Drawing Sheets

PAPER SHREDDER WITH SERVICE POWER OUTLET

This is a continuation of application Ser. No. 372,128 filed June 27, 1989 now abandoned, which is a continuation of application Ser. No. 163,532 filed Mar. 3, 1988, now abandoned.

BACKGROUND OF THE INVENTION

This invention relates to a paper shredder for shredding large amounts of paper into small bits and more particularly to such a paper shredder provided with a service power outlet.

Conventional paper shredders are not provided with a service power outlet and if a user wishes to use an electric vacuum cleaner to clean its interior or the surrounding area, the vacuum cleaner must be plugged into a power outlet somewhere near the shredder. Documents to be shredded are very often stapled together and an electric staple-remover and/or some other electrical office equipment is often provided near a shredder. It is frequently troublesome, however, to find a power outlet for each of such service equipment. In most situations where a shredder is used, a vacuum cleaner and such office equipment are plugged into the same outlet behind the shredder to which it is plugged.

SUMMARY OF THE INVENTION

It is therefore an object of the present invention to eliminate the aforementioned problems of conventional paper shredders which arise when it becomes desirable to use near the shredder another electrical equipment such as a vacuum cleaner related to the operation of the shredder itself.

It is another object of the present invention to provide a shredder which can supply power to another electrical equipment only when it itself is not being operated.

The above and other objects of the present invention are achieved by providing a shredder comprising not only cutters, a cutter driver for moving the cutters, a power source for providing power to this cutter driver, a service power outlet from which power can be supplied to another electrical equipment such as a vacuum cleaner, and a cover or a door which can close to render the service power outlet inaccessible but also a control unit which serves to prevent the supply of power to the cutter driver if the aforementioned cover or door is opened. Thus, a vacuum cleaner or the like can be operated by deriving power from the service power outlet provided on the shredder itself but only while the cutters are not operating such that overloading of the power source and a resultant voltage drop can be prevented.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
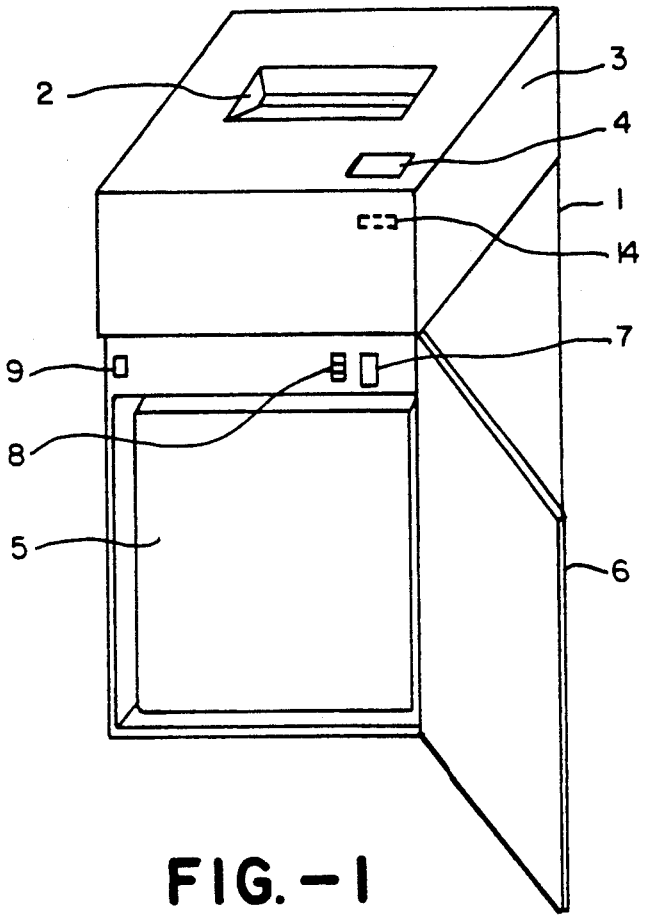
FIG. 1 is a schematic diagonal view of a paper shredder embodying the present invention.

As shown in FIG. 1, a paper shredder embodying the present invention has formed at the top of its housing 1 an inlet 2 through which documents to be shredded are thrown in and the documents thus thrown in are shredded into pieces by a pair of cutters (not shown) disposed inside a shredding section 3 such that the documents can no longer be read. On the upper surface of the shredding section 3 is a control panel 4 provided with keys for causing the cutters to rotate in one direction or the other and for stopping their motion. The documents shredded into bits by the cutters are discharged into a discharge receptacle 5 disposed inside the housing 1. When this discharge receptacle 5 becomes full with the shredded bits of documents, it is removed by opening a front door 6 and emptied.

A power switch 7 and a service power outlet 8 are provided on the front side of the housing 1 inside the door 6 so as to be opposite to and directly face the door 6 when it is closed. A door switch 9 of a known kind is further provided on the housing 1 for the purpose of detecting whether the door 6 is to be considered closed or open.

If the interior of the housing 1 needs cleaning, for example, the plug of an electric vacuum cleaner (not shown) is inserted into the service power outlet 8 such that power can be supplied to the cleaner from the housing 1 itself. Since the service power outlet 8 is disposed inside the housing 1, it is very convenient for cleaning its interior. At the same time, since the service power outlet 8 is disposed opposite to the door 6 when it is closed, the power outlet 8 is accessible only when the door 6 is open. In other words, the vacuum cleaner and the like can be operated from this power outlet only when the door 6 is open and hence the cutters are not operating. This serves to prevent the overloading of the power source.

Figure 2:
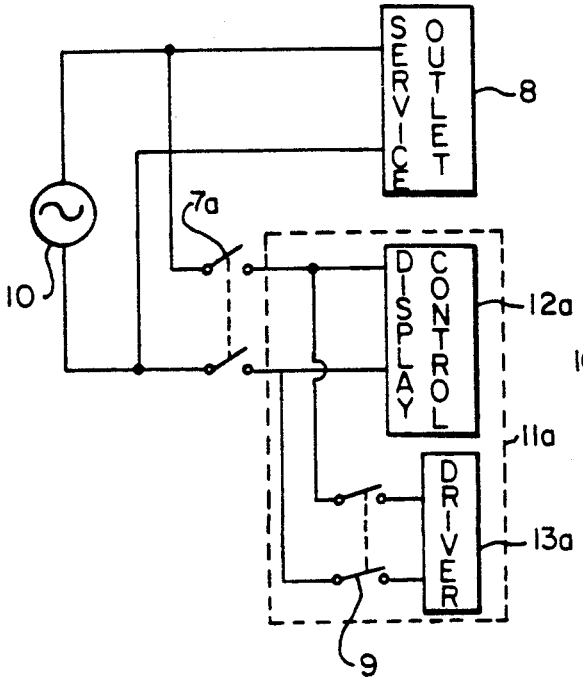
FIG. 2 is a circuit diagram for the operation of the shredder shown in FIG. 1.

With reference next to FIG. 2 which shows the structure of a control circuit for the shredder described above, the AC power from a source 10 is connected not only directly to the service power outlet 8 but also through a main power switch **7*a* to a shredder control section 11*a* having a display control section 12*a* and a cutter driver section 13*a*. The aforementioned door switch 9 is adapted to control the power supply to the cutter driver section 13*a*. Even if the main power switch 7*a* is turned on, power is not supplied to the cutter driver section 13*a* when the service power outlet 8 is used because the door 6 must be opened to reach the power outlet 8 and the opening of the door 6 causes the door switch 9** to be turned off. Thus, safety of operation of the shredder is guaranteed because the cutters cannot start operating while, for example the interior of the shredder is being vacuumed.

Figure 3:
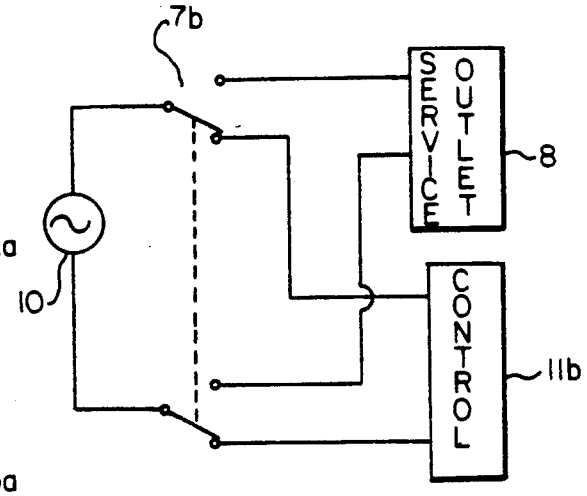
FIG. 3 is a circuit diagram for another paper shredder embodying the present invention.

FIG. 3 is a circuit diagram of another control unit embodying the present invention for the shredder shown in FIG. 1. This control circuit is characterized by a main switch **7*b* with which, as shown, power from the AC source 10 can be selectively supplied either to the power outlet 8** or to the shredder control section 11*b*. In other words, the service power outlet 8 is inactivated while the shredder is operating, independently of the position of the door 6. Thus, the power outlet 8 may be placed at a position indicated, for example, by the numeral 14 in FIG. 1, that is, outside the door 6. In this case, the vacuum cleaner or the like may be safely left plugged into the service power outlet 8.

Figure 4:
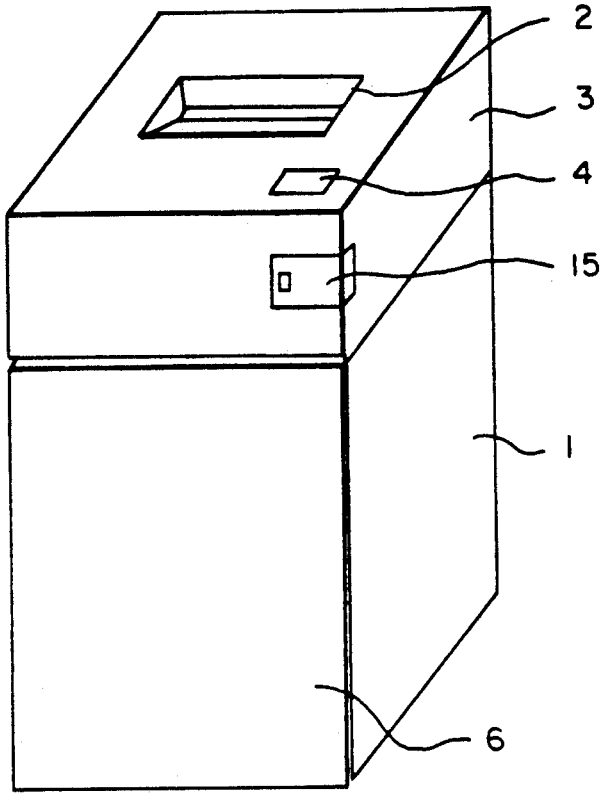
FIG. 4 is a schematic diagonal view of still another shredder embodying the present invention.
Figure 5:
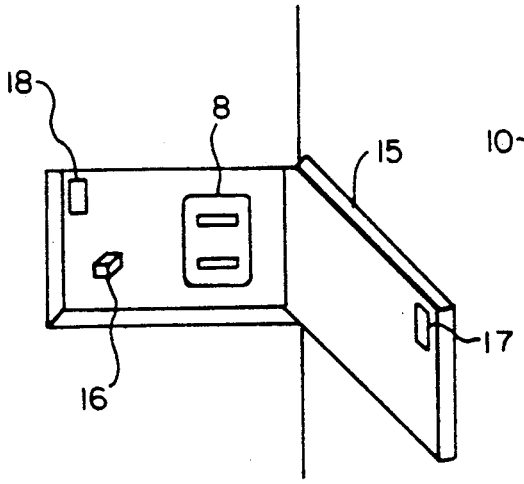
FIG. 5 is a diagonal view of a portion of the shredder shown in FIG. 4 when its cover is opened.
Figure 6:
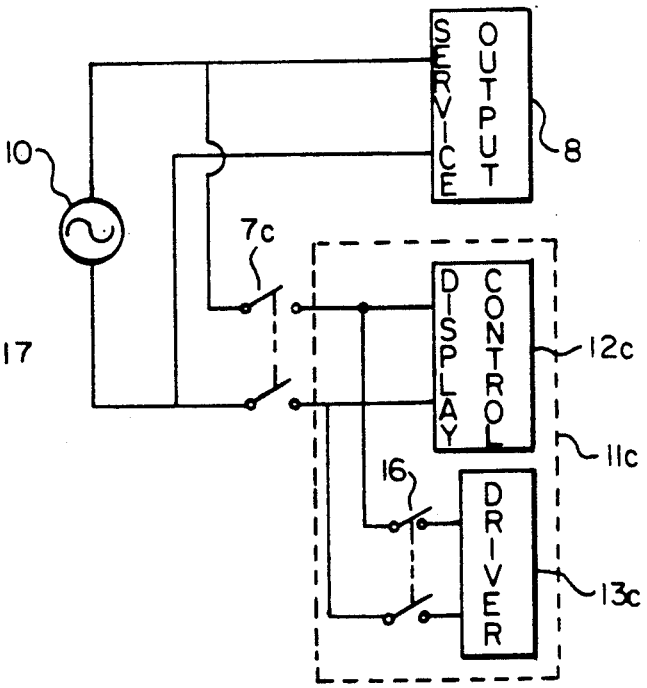
FIG. 6 is a circuit diagram for the shredder shown in FIGS. 4 and 5.

FIG. 4 is an external view of another shredder embodying the present invention characterized as having a small openable cover 15 provided to the shredding section 3 and the service power outlet 8 and a cover switch 16 disposed behind the cover 15 so as to become exposed when the cover 15 is opened as shown in FIG. 5. A small quadrangular iron piece 17 is attached to the cover 15 near its edge and a magnet 18 is affixed correspondingly such that the attractive force of the magnet 18 to the iron piece 17 keeps the cover 15 in the closed position. As the cover 15 is closed, the cover switch 16 becomes pressed thereby but as the cover 15 is opened, the cover switch 16 also returns to the open position. FIG. 6 is a circuit diagram for controlling this shredder. Components therein which are substantially identical or at least similar to those shown in FIG. 1 and described above are indicated by the same numerals. Structurally, it is identical to the diagram in FIG. 2, except the power supply to the cutter driver section 13*c* is controlled by the cover switch 16. Accordingly, the cutter driver 13*c* is inactivated when the service power outlet 8 is being used even if the main power switch 7*c* is turned on because the cover 15 must necessarily be open when the power outlet 8 is used and this causes the cover switch 16 to open and power is not supplied to the driver section 13*c*.

The foregoing description of preferred embodiments of the invention has been presented for purposes of illustration and description. It is not intended to be exhaustive or to limit the invention to the precise form disclosed. Any modifications and variations which may be apparent to a person skilled in the art are intended to be included within the scope of this invention.

What is claimed is:

1. A shredder comprising a cutter means for shredding paper, driver means for driving said cutter means, power outlet means for supplying power to external electrical equipment, a power source for supplying power, a display means for displaying operating conditions of said shredder, a first switching means for selectably allowing and disallowing power from said power source to be supplied therethrough to said driver means and to said display means, a second switching means for selectably allowing and disallowing power from said power source to be supplied therethrough to said driver means irrespective of whether or not power from said power source is being supplied to said display means, and an openable cover door means covering said first and second switching means, said second switching means being controlled by the closing and opening of said openable cover door means.

2. The shredder of claim 1 further comprising a receptacle means for receiving and containing shredded pieces cut by said cutter means, said openable cover door means further covering said receptacle means.

* * * * *